United States Patent [19]

Wood

[11] 4,228,757

[45] Oct. 21, 1980

[54] BOAT STEERING ASSEMBLY

[75] Inventor: Robert A. R. Wood, West Vancouver, Canada

[73] Assignee: Teleflex Incorporated, Limerick, Pa.

[21] Appl. No.: 926,662

[22] Filed: Jul. 21, 1978

[51] Int. Cl.[3] ..... B63H 25/22

[52] U.S. Cl. ..... 114/150; 74/480 B; 74/486; 74/492; 114/162

[58] Field of Search ..... 114/144 R, 146, 150, 114/162; 115/18 R, 18 A, 18 B; 74/480 B, 484 R, 486, 491, 492, 494, 495, 496; 92/140

[56] References Cited

U.S. PATENT DOCUMENTS

| | | | |
|---|---|---|---|
| 2,028,089 | 1/1936 | Erling | 114/150 X |
| 2,891,498 | 6/1959 | Schroeder | 114/450 |
| 2,908,478 | 10/1959 | Starrett | 92/140 X |
| 3,181,491 | 5/1965 | Dunning | 74/480 B X |
| 3,595,193 | 6/1971 | Heese | 114/450 |
| 3,911,847 | 10/1975 | Worthing | 114/150 |
| 4,020,713 | 5/1977 | Cantley et al. | 74/480 B X |
| 4,041,889 | 8/1977 | Blanchard | 114/150 X |
| 4,054,102 | 10/1977 | Borst et al. | 74/480 B X |

*Primary Examiner*—Trygve M. Blix

*Assistant Examiner*—Winston H. Douglas

*Attorney, Agent, or Firm*—McGlynn and Milton

[57] ABSTRACT

A boat steering assembly having a tiller lever for providing a steering input upon being pivoted about a first pivot axis and an actuating lever supported for pivotal movement about a second pivot axis. The ends of the levers are interconnected in order to pivot the tiller lever upon pivoting movement of the actuating lever and for positioning the levers in parallel relationship with one another in a neutral position. The length of the tiller lever from its first pivot is longer than the length of the actuating lever from its second pivot to their respective ends. There is also an acutator assembly comprising a reciprocating member having a hydraulically operated piston at each end which is slidably disposed for movement between two cylinders which are defined by a housing. A first end of an actuating lever is operatively connected to the housing and a second end extends out of the housing and is adapted for connection to a steering means. A drive member supported by the reciprocating member provides a driving connection between the actuating lever and the reciprocating member.

19 Claims, 6 Drawing Figures

BOAT STEERING ASSEMBLY

BACKGROUND OF THE INVENTION

1. Field of the Invention

The subject invention relates to a novel assembly for steering boats and ships. A conventional cylinder is the most commonly used form of actuator for steering vessels, particularly of the inboard type. The subject invention, however, may be used with boats of either the outboard or inboard type. Steering systems for inboard-type motor boats have a tiller arm or lever which is mounted on a rudder post which operates a rudder. An actuator is associated with the tiller to ultimately control the position of the rudder which, in turn, effects the direction of the boat. The subject invention also relates to an improved actuator which has an especially useful application with boat steering systems.

2. Description of the Prior Art

Typically, the prior art boat steering assemblies and actuators employed therewith are comprised of a conventional hydraulic cylinder which actuates a tiller mounted on a rudder post or modified for use with an outboard-type vessel; however, the prior art boat steering assemblies and actuators have a problem in that a drop in rudder torque occurs as the cylinder moves into a hard-over position. In other words, when steering a vessel, the steering would become difficult in a hard-over position especially in an inboard/outboard vessel where the outdrive must be steered. Even various special arrangements of conventional cylinders or actuators which are designed to increase the torque in a maximum rudder or hard-over position have a problem in that if output torque is increased when going ahead, it is reduced when going astern. A still further problem is to provide a consistent feel of effort throughout the range of steering rather than a condition where steering is effortless in one position and hard in another.

SUMMARY OF THE INVENTION

The subject invention relates to an improved boat steering assembly comprising boat steering means including a tiller lever for providing a steering input upon being pivoted about a first pivot axis and an actuator means including an actuating lever supported for pivotal movement about a second pivot axis. The tiller lever extends from its first axis to a second end and the actuating lever extends from its second pivot axis to a second end. Linkage means interconnect the second ends of the levers for pivoting the tiller lever upon pivoting movement of the actuating lever and also positions the levers in parallel relationship with one another in a neutral position. The tiller lever is longer in length between its first pivot and second end and the length of the actuating lever between its second pivot and second end.

Additionally, the subject invention relates to an improved actuator which may be used with the subject boat steering assembly comprising a housing defining two cylinders disposed on an axis and a reciprocating member having a piston at each end thereof. The pistons are axially aligned and slidably disposed in the cylinders for reciprocating movement along their axis. Conduit means are associated with each of the cylinders to allow the cylinders to communicate with a hydraulic pump means whereby hydraulic fluid pressure is alternately supplied through the conduit means to move the pistons in opposite directions. An actuating lever has a first end operatively connected to the housing and a second end extending out of the housing and adapted for connection to a steering means. The actuating lever is operatively connected to the reciprocating member at a drive point positioned between the ends of the lever whereby movement of the reciprocating member along its axis effects arcuate movement of the second end of the lever for actuating the steering means.

PRIOR ART STATEMENT

U.S. Pat. No. 2,891,498 granted June 23, 1959 to Simon E. Schroeder discloses a hydraulic control mechanism for motor boats. The steering system disclosed in this patent employs a rack and pinion actuator wherein the piston has a rack hobbed into the side. A problem with this assembly, as alluded to above, is that the rack and pinion actuator produces a constant torque regardless of rudder position which makes steering difficult in a hard-over position especially with an inboard/outboard vessel where the outdrive must be steered. Actuator assemblies having an actuator lever with a pin and slot connection to a reciprocating member and pivotally connected at a point beneath the reciprocating member with its distal end connected to a link for operation of a remote device is disclosed in U.S. Pat. No. 2,908,478 granted Oct. 13, 1959 to Delbert Starrett and U.S. Pat. No. 3,298,286 granted Jan. 17, 1967 to Brody W. Tyler. Additionally, U.S. Pat. No. 2,771,845 granted Nov. 27, 1956 to Joseph A. Eagan discloses an actuator employing an actuating lever having one end centrally connected to a reciprocating member with the other end slidably connected to a crank pin circle for use as a proportioning pump. However, none of these patents discloses an actuator assembly wherein a housing defines two cylinders with a reciprocating member slidably disposed in the cylinders and an actuating lever having a first end operatively connected to the housing and a second end extending out of the housing and adapted for connection to a steering means.

BRIEF DESCRIPTION OF THE DRAWINGS

Other advantages of the present invention will be readily appreciated as the same becomes better understood by reference to the following detailed description when considered in connection with the accompanying drawings wherein.

DESCRIPTION OF PREFERRED EMBODIMENT

Figure 1:
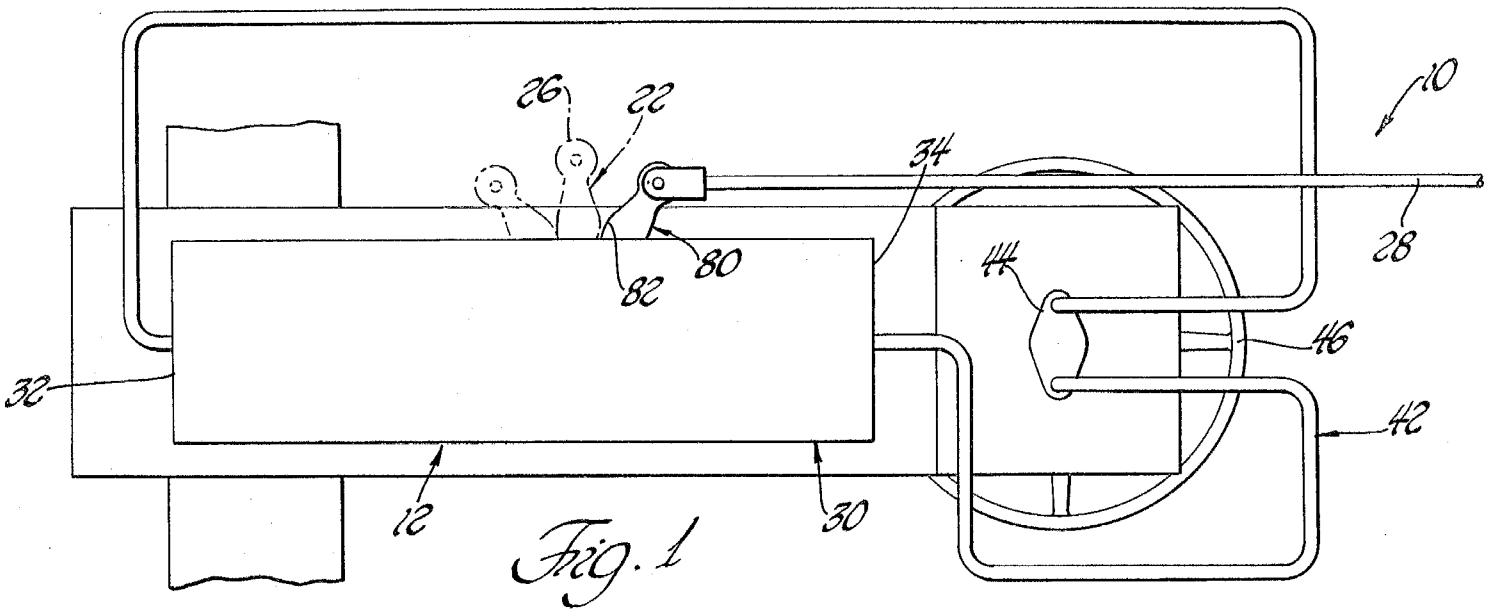
FIG. 1 shows a boat steering assembly constructed in accordance with the instant invention shown in operative association with a hydraulic system.

Referring to the drawings generally, a boat steering assembly is generally shown at 10 and an actuator assembly is generally shown at 12 constructed in accordance with the instant invention.

Figure 2:
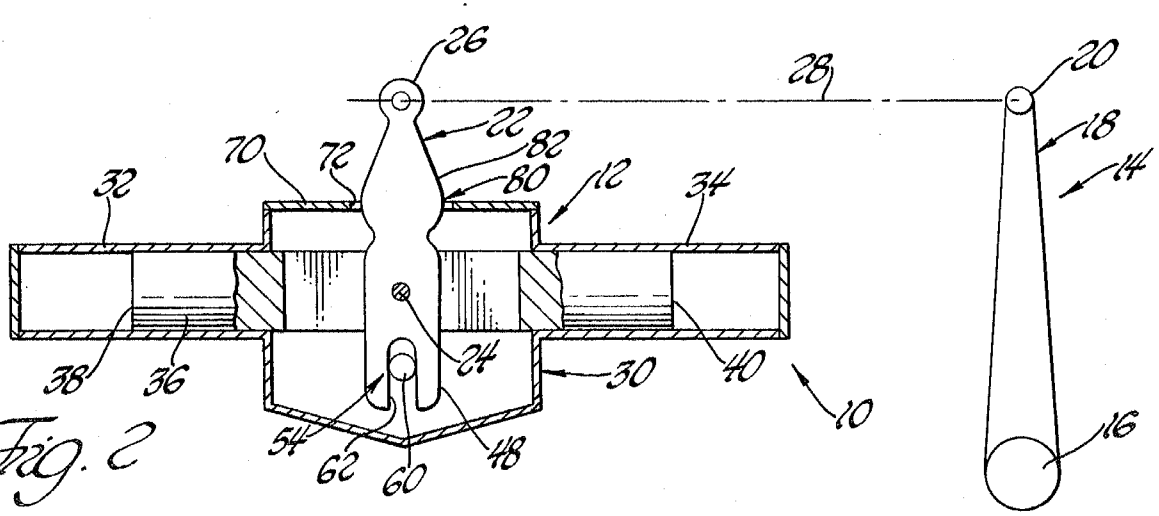
FIG. 2 is a schematic view partially broken away and in cross section of a boat steering assembly constructed in accordance with the instant invention.
Figure 6:
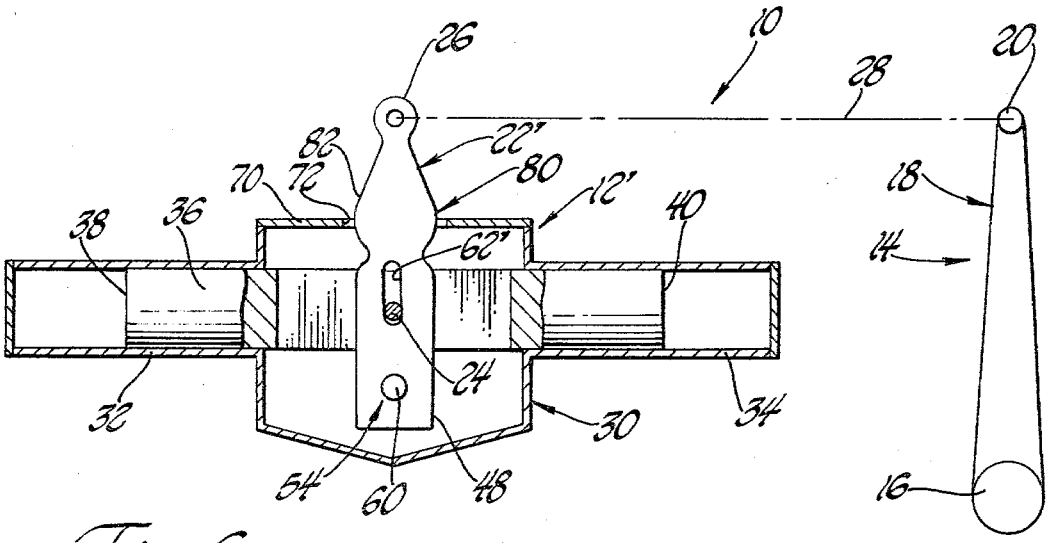
FIG. 6 is a schematic elevational view partially broken away and in cross section of another embodiment of a boat steering system constructed in accordance with the instant invention.

Referring to FIGS. 2 and 6, a steering means for steering a boat is generally shown at 14. The steering means 14 includes a control means such as a rudder post 16 for controlling the position of a rudder to thereby control the direction of the boat. When the subject invention is employed with an outboard-type boat, however, the control means will take the form of a movably mounted motor whereby the position of the motor effects steering or direction of the boat.

As shown in FIG. 2, the boat steering means 14 includes a tiller lever generally shown at 18 for providing a steering input upon being pivoted about a first pivot axis defined by the rudder post 16. The tiller lever 18 extends from its first pivot axis 16 to a second end 20. Actuator means or the actuator assembly 12 includes an actuating lever generally indicated at 22 supported for pivotal movement about a second pivot axis 24 and extends from the second pivot axis 24 to a second end 26. Linkage means such as a tie bar 28 interconnects the second end 20 of the tiller lever 18 and the second end 26 of the actuating lever 22 for pivoting the tiller lever 18 upon pivoting movement of the actuating lever 22 and for positioning the actuating lever 22 and tiller lever 18 in parallel relationship with one another in a neutral position as shown in FIGS. 2 and 6. Also, the tiller lever 18 is longer in length between its first pivot 16 and its second end 20 than the length of the actuating lever 22 between its second pivot 24 and its second end 26.

In operation, the tiller lever 18 is operatively associated with the control means or rudder post 16 so that arcuate movement of the tiller lever 18 effects rotation of the rudder post 16 to thereby control the position of the rudder in order to steer the boat. The tiller lever 18 is actuated by the actuator means 12 through the linking means or tie bar 28 in order to allow the actuating lever 22 to move the tiller lever 18. Consequently, for example, if the actuating lever 22 is moved 45°, the tiller lever 18 is moved only 35° to provide ease in steering effort, i.e., a mechanical advantage.

Referring to the drawings generally, the actuator means or actuator assembly 12 includes a housing generally indicated at 30 which defines or includes two cylinders 32 and 34 which are disposed on an axis. It is also possible that the two cylinders 32 and 34 are separate members that are connected to the housing 30. A reciprocating member 36 has a piston 38 at one end and another piston 40 at the other end. The pistons 38 and 40 are axially aligned and slidably disposed in the cylinders 32 and 34 for reciprocating movement along the axis of the cylingers 32 and 34.

Conduit means generally indicated at 42 are associated with each of the cylinders 32 and 34 for allowing the cylinders 32 and 34 to communicate with a hydraulic pump means, schematically indicated at 44 in FIG. 1. Thus, hydraulic fluid pressure is alternately supplied through the conduit means 42 to move the pistons 38 and 40 in opposite directions. Referring to FIG. 1, the hydraulic pump means 44 alternately supplies hydraulic fluid pressure to the conduit means 42 and input means 46 controls the pump means 44 thereby controlling the direction of movement of the reciprocating member 36. The input means 46 is associated with or may be a part of a steering wheel or the like which may be turned to thereby control the input to the hydraulic pump means 44. Consequently, hydraulic fluid flowing through the conduit 42 on the right side of FIG. 1, into cylinder 34, will provide an input to the piston 40 to move the reciprocating member 36 toward the left of FIG. 1 and the conduit 42 associated with the cylinder 32 will function as an outlet for the fluid pressure. Alternatively, if the input means 46 controls the pump means 44 to supply fluid pressure to the left of FIG. 1; i.e., through the conduit 42 into cylinder 32, then the reciprocating member 36 will move toward the right and the cylinder 34 and its associated conduit 42 will function as the outlet or release for fluid pressure.

The actuating lever 22 has a first end 48 operatively connected to the housing 30 while, as indicated earlier, the second end 26 extends out of the housing 30 and is adapted for connection to the steering means 14. The actuating lever 22 is operatively connected to the reciprocating member 36 at a drive point or pivot axis 24. The drive point 24 is positioned between the ends 26 and 48 of the actuating lever 22 whereby movement of the reciprocating member 36 along its axis effects arcuate movement of the second end 26 of the actuating lever 22 for actuating the steering means 14.

The drive point or pivot axis 24 is defined by a drive member, also indicated as 24, which is supported by the reciprocating member 36 and movable therewith for providing the driving connection between the actuating lever 22 and the reciprocating member 36. In other words, the drive member 24 is associated with the reciprocating member 36 at a position between the pistons 38 and 40 and with the actuating lever 22 at the drive point which is between the ends 26 and 48 of the lever 22.

Figure 3:
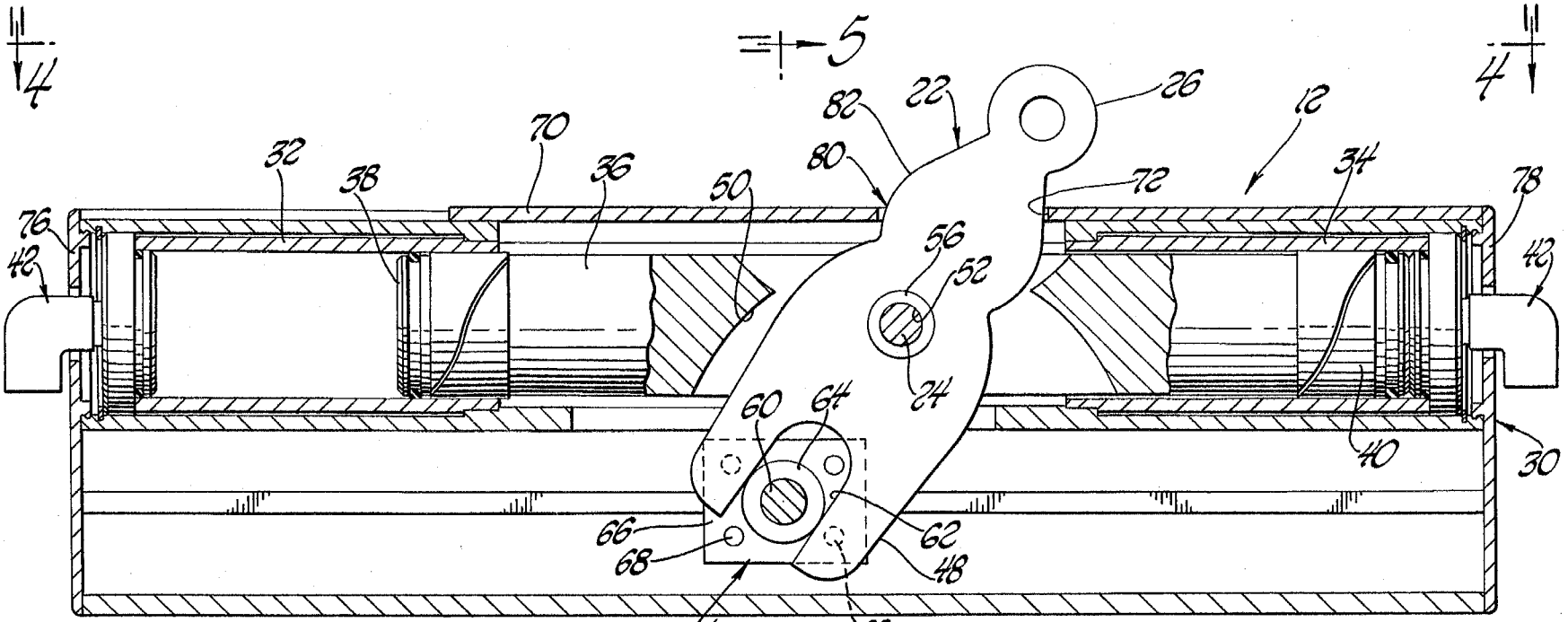
FIG. 3 is an elevational view partially broken away and in cross section illustrating details of a first embodiment of an actuator assembly constructed in accordance with the instant invention.
Figure 4:
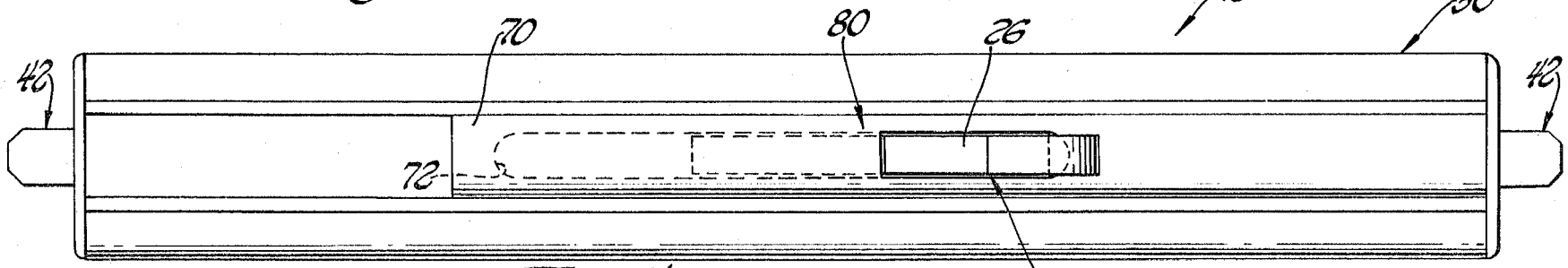
FIG. 4 is a plan view taken substantially along line 4—4 of FIG. 3.
Figure 5:
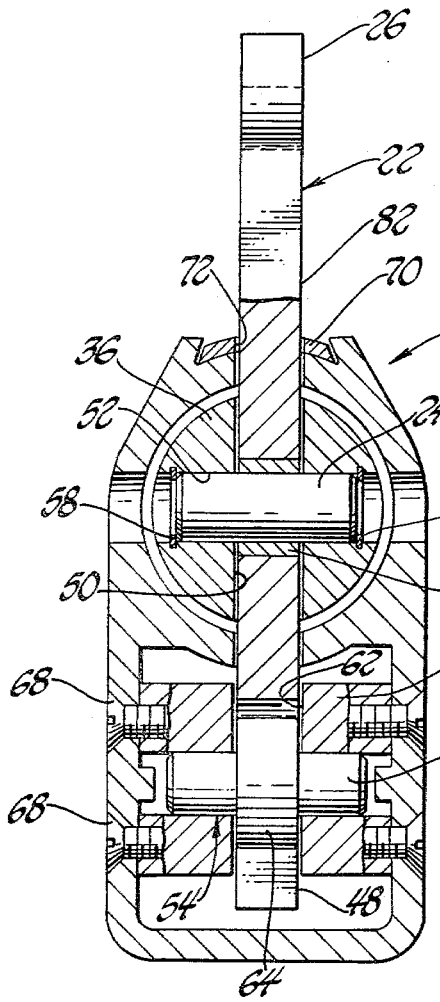
FIG. 5 is a cross-sectional view taken substantially along line 5—5 of FIG. 3.

As best seen in FIGS. 3 and 5, the reciprocating member 36 includes a first opening 50 to allow the actuating lever 22 to extend therethrough and a second opening 52 intersecting the first opening 50 to receive the drive member 24. A connecting means generally indicated at 54 is supported by the housing 30 and operatively interconnects the first end 48 of the actuating lever 22 and the housing 30.

In the embodiment shown in FIGS. 2, 3, 4 and 5, the actuating lever 22 is rotatably supported on the drive member 24. As best seen in FIGS. 3 and 5, the drive member 24 is in the form of a drive pin which is rotatably supported by needle bearings 56 and suitable circlips 58.

The connection means 54 includes a slide member 60, which may also take the form of a pin, which is fixed to the housing 30. Still referring to the embodiment shown in FIGS. 2, 3, 4 and 5, the connection means 54 also includes an elongated slot 62 in the first end 48 of the actuating lever 22 which is in sliding engagement with the slide member 60 whereby the lever 22 pivots about the drive member 24 as the slot 62 slides along the slide member 60 upon reciprocation of the pistons 38 and 40 of the reciprocating member 36. The connection means 54 also includes needle bearings 64 which are mounted in a spacer member 66 which is connected to a housing 30 by screws 68 or the like.

The components of the embodiment shown in FIG. 6 are the same as those described in connection with the first embodiment except those indicated with a prime. The actuating lever 22' of the actuator means or actuator assembly 12' includes an elongated slot 62' which is disposed about the drive member 24 whereby the actuating lever 22′ pivots about the connection means 54 and the drive member 24 moves along the slot 62′ upon reciprocation of the pistons 38 and 40 of the reciprocating member 36.

The inside width of the slot 62 is larger than the outside diameter of the slide member 60 and, in the embodiment shown in FIG. 6, the inside width of the slot 62′ is larger than the drive member 24. Thus, when one of the members; i.e., drive member 24 or slide member 60 engages the slot 62 or 62′, then the drive member 24 in FIG. 6 or the slide member 60 in FIGS. 1 through 5, move up one side of the slot 62 and down the other depending upon the direction of movement of the reciprocating member 36 which provides still further mechanical advantage.

The assembly 10 includes a slipper member 70 which is slidably mounted on the housing 30 for enclosing the housing 30 with a part of the actuating lever 22 disposed therein. The slipper member 70 has an opening 72 and the actuating lever 22 extends through this opening 72. It is also noted that the housing 30 includes molded end caps 76 and 78 for the cylinders 32 and 34 to mount the slipper member 70. The detail of the molded end caps 76 and 78 is best illustrated in FIG. 3.

A sealing means generally indicated at 80 provides a seal between the slipper member 70 and the actuating lever 22 which extends therethrough. The sealing means 80 includes a portion 82 of the actuating lever 22 which extends through the opening 72 in the slipper member 70. More specifically, this portion 82 of the lever 22 has a bulbous shape in order that this portion 82 remains in sealing contact with the slipper member 70 as the activating lever 22 moves. In other words, the bulbous shape of the portion 82 of the actuating lever 22 extending through the opening 72 of the slipper member 70 is of such a configuration so as to maintain sealing engagement between the lever 22 and the slipper member 70 as the actuating lever 22 moves from side-to-side and as the slipper member 70 slides along the housing 30. The lever 22′ of FIG. 6 is also of a bulbous shape.

The subject invention provides a solution to the problems which were mentioned earlier. When employed with a boat steering system, the subject invention provides an increased torque output to a rudder post 16 when it is desired to steer a boat in a hard-over or maximum rudder position. The actuator means or actuator assembly 12 and 12′ includes a slide means; i.e., a drive member or slide member moving along a slot, for providing increased leverage as the actuating lever 22 is moved from its neutral or fore and aft position. Additionally, the offset connection of the steering means 14 to the actuator means further facilitates a solution to the aforementioned problems. Thus, the subject invention provides the increased torque in a hard-over position while still maintaining consistent steering effort. In other words, the steering operation is not hard in one position and then becomes effortless or falls away in another position.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, the invention may be practiced otherwise than as specifically described.

The embodiments of the invention in which an exclusive property or privilege is claimed are defined as follows:

1. A boat steering assembly comprising; boat steering means including a tiller lever having a first end and a second end for providing a steering input upon being pivoted about a first pivot axis; said tiller lever extending from said first axis to said second end, actuator means including an actuating lever, having a first end and a second end supported for pivotal movement about a second pivot axis, said actuating lever extending from said second pivot axis to said second end, linkage means interconnecting said second ends of said levers for pivoting said tiller lever upon pivoting movement of said actuating lever and for positioning said levers in parallel relationship with one another in a neutral position, said tiller lever being longer in length between said first pivot and said second end thereof than the length of said actuating lever between said second pivot and said second end thereof so that said tiller lever rotates a smaller angle than said actuating lever in response to rotation thereof from said neutral position by said actuating lever.

2. An assembly as set forth in claim 1 wherein said actuator means includes a slide means for providing increased leverage as said actuating lever is moved from its neutral position.

3. An assembly as set forth in claim 2 wherein said actuator means includes a reciprocating member and a drive member operatively connecting said reciprocating member to said actuating lever.

4. An assembly as set forth in claim 3 wherein said slide means includes a slide member fixed to a housing and an elongated slot in said actuating lever positioned for sliding engagement with said slide member whereby said actuating lever pivots about said drive member as said slot slides along said slide member upon reciprocating of said reciprocating member.

5. An actuator assembly comprising; a housing defining two cylinders disposed on an axis, a reciprocating member having a piston at each end thereof, said pistons being axially aligned and slidably disposed in said cylinders for reciprocating movement along said axis, conduit means associated with each of said cylinders for allowing said cylinders to communicate with a hydraulic pump means whereby hydraulic fluid pressure may be alternately supplied through said conduit means to move said pistons in opposite directions, an actuating lever having a first end operatively connected to said housing and a second end extending out of said housing and adapted for connection to a steering means, said actuating lever being operatively connected to said reciprocating member at a drive point positioned between said ends whereby movement of said reciprocating member along said axis effects arcuate movement of said second end of said lever for actuating the steering means.

6. An assembly as set forth in claim 5 including a hydraulic pump means for alternately supplying hydraulic fluid pressure to said conduit means, and input means for controlling said pump means thereby controlling the direction of movement of said reciprocating member.

7. An assembly as set forth in claim 5 including a drive member supported by said reciprocating member and movable therewith for providing a driving connection between said actuating lever and said reciprocating member, said drive member being associated with said reciprocating member at a position between said pistons and with said actuating lever at said drive point between said ends of said lever.

8. An assembly as set forth in claim 7 wherein said reciprocating member includes a first opening to allow said lever to extend therethrough and a second opening intersecting said first opening to receive said drive member.

9. An assembly as set forth in claim 7 including a connecting means supported by said housing for operatively interconnecting said first end of said acutating lever and said housing.

10. An assembly as set forth in claim 9 wherein said actuating lever is rotatably supported on said drive member, said connection means includes a slide member fixed to said housing and an elongated slot in said first end of said actuating lever and in sliding engagement with said slide member whereby said lever pivots about said drive member as said slot slides along said slide member upon reciprocation of said pistons.

11. An assembly as set forth in claim 9 wherein said actuating lever includes an elongated slot disposed about said drive member whereby said actuating lever pivots about said connection means and said drive member moves along said slot upon reciprocation of said pistons.

12. An assembly as set forth in claim 9 wherein said drive member and said connection means include needle bearings for providing rolling contact.

13. An assembly as set forth in claim 5 including a slipper member slidably mounted on said housing for enclosing said housing with said actuating lever, said slipper member having an opening and said lever extends therethrough.

14. An assembly as set forth in claim 13 including sealing means for providing a seal between said slipper and said actuating lever extending therethrough.

15. An assembly as set forth in claim 14 wherein said sealing means includes a portion of said lever extending through said opening in said slipper having a bulbous shape whereby said portion remains in sealing contact with said slipper member as said lever moves.

16. An assembly as set forth claim 5 including a steering means for steering a boat.

17. An assembly as set forth in claim 16 wherein said steering means includes a control means for controlling the direction of the boat, a tiller lever operatively associated with said control means, and a linking means for linking said actuating lever and said tiller lever.

18. An assembly as set forth in claim 17 wherein the length of said tiller lever is greater than the length of said actuating lever.

19. An assembly as set forth in claim 18 wherein said control means includes a rudder post for controlling the position of a rudder, said rudder post being operatively associated with said tiller lever whereby arcuate movement of said tiller effects rotation of said rudder post to thereby control the position of the rudder.

* * * * *